US005639350A

United States Patent [19]

Aula et al.

[11] Patent Number: 5,639,350

[45] Date of Patent: *Jun. 17, 1997

[54] METHOD OF AND APPARATUS FOR CUTTING A LEAD-IN STRIP OF PAPER WEB

[75] Inventors: Jouko Aula, Muurame; Allan Liedes, Palokka; Auvo Saari, Jyväskylä, all of Finland

[73] Assignee: Valmet Corporation, Helsinki, Finland

[ * ] Notice: The portion of the term of this patent subsequent to Feb. 9, 2010, has been disclaimed.

[21] Appl. No.: 876,175

[22] Filed: Apr. 30, 1992

Related U.S. Application Data

[63] Continuation of Ser. No. 658,033, Feb. 20, 1991, Pat. No. 5,185,063.

[30] Foreign Application Priority Data

Feb. 22, 1990 [FI] Finland ..... 900902

[51] Int. Cl.$^6$ ..... D21F 5/04

[52] U.S. Cl. ..... 162/193; 162/194; 162/286; 34/116; 34/117

[58] Field of Search ..... 162/193, 194, 162/286; 34/116, 117, 123, 120

[56] References Cited

U.S. PATENT DOCUMENTS

| | | | |
|---|---|---|---|
| 4,918,836 | 4/1990 | Wedel | 162/193 |
| 4,934,067 | 6/1990 | Wedel | 34/116 |
| 4,945,655 | 8/1990 | Wedel | 162/194 |
| 4,982,513 | 1/1991 | Loser et al. | 34/116 |
| 5,105,561 | 4/1992 | Wulz | 34/120 |
| 5,185,063 | 2/1993 | Aula et al. | 162/193 |

*Primary Examiner*—Karen M. Hastings

*Attorney, Agent, or Firm*—Cohen, Pontani, Lieberman, Pavane

[57] ABSTRACT

A method and apparatus for cutting a paper web (W) in a group of drying cylinders provided with single-wire draw (13) in a paper machine or a finishing machine. The drying wire (13) is separated from the paper web (W) by one or more guide rolls (14a, 14b) thereby creating a open draw ($W_O$) for the web (W). The cutting of the paper web (W) is carried out at the open draw ($W_O$) of the web (W). After the open draw ($W_O$), the drying wire (13) and the web (W) are rejoined on the surface of the following leading or drying cylinder (11). Preferably, two guide rolls (14a, 14b) are utilized whereby the first roll is disposed so that the drying wire (13) supports the web (W) up to the location of the guide roll (14a), which is followed by an open draw ($W_O$) of the web. The drying wire (13) is returned onto the following leading or drying cylinder (11) with the second guide roll (14b).

5 Claims, 1 Drawing Sheet

METHOD OF AND APPARATUS FOR CUTTING A LEAD-IN STRIP OF PAPER WEB

This is a continuation of application Ser. No. 07/658,033, filed Feb. 20, 1991 now U.S. Pat. No. 5,185,063.

FIELD OF THE INVENTION

The present invention relates to a method of cutting a paper web and, particularly, for diagonal or oblique cutting of the leader or lead-in strip of a paper web in a group of drying cylinders provided with a single-wire draw in a paper machine or a finishing machine.

The invention also relates to an apparatus for carrying out the above method comprising a transversely disposed beam placed underneath a drying cylinder in a group of cylinders with a single-wire draw and on which beam a carriage fitted with a web cutting blade such as a rotary blade, a pin-shaped or knife-shaped cutting blade is arranged to travel substantially perpendicularly to the direction of the web.

BACKGROUND AND SUMMARY OF THE INVENTION

A number of different so-called diagonal cutters are known which are disposed in the dryer section of a paper machine, in particular at the downstream end or dry end of the dryer section. In these prior art diagonal cutters a pin fixed to a mechanical traverse has been used as the tool for cutting the leader of the web and for diagonal shearing or cutting of the web. As the cutting pin is contacting the surface of the drying cylinder it is disadvantageous in this arrangement that the pin scratches the cylinder surface and soon becomes dull seriously affecting the quality of the cut.

It is also known to use, as a diagonal cutter, a device similar to a circular saw mounted on a traversing carriage or to carry out the diagonal or oblique cutting manually with a suitable knife.

A device for cutting the leader of a paper web is known from applicant's U.S. Pat. No. 4,566,944, the entire disclosure of which is hereby incorporated herein by reference. This device comprises a beam mounted in connection with a multi-cylinder dryer of a paper machine in a direction transverse to the path of the paper. The beam is provided with a traversing carriage on which a web-cutting blade is mounted. The apparatus of U.S. Pat. No. 4,566,944 includes a carriage bearing the cutting blade while the substantially plain carriage face is provided with means for blowing air against the web to stabilize the web and prevent fluttering thereof. The blow means include oppositely disposed nozzle slots or suitable nozzle holes within the carriage.

A problem has, however, arisen in the prior art methods and devices when utilized in connection with a single-wire draw in a multi-cylinder dryer of a paper machine or a finishing machine. A multi-cylinder dryer with a single wire draw generally comprises two rows of heated drying cylinders, one row disposed above the other, or one row of heated drying cylinders and one row of unheated leading rolls or cylinders with and without vacuum. Between the rows of cylinders and/or leading rolls, in each group of single-wire draw, the web is supported by the drying wire or drying felt so that the cylinders in one row of cylinders, as a rule in the row of upper cylinders, are placed outside the loop of the drying wire and the lower cylinders or lead rolls are located inside the loop of the drying wire or felt. Thus, in a single-wire draw, the web of paper is also supported on the usually straight runs between the rows of respective cylinders. In the case of twin-wire draws, the paper web has a free-unsupported run between the two respective cylinders or groups of cylinders so that the prior-art diagonal cutters can be used at this location, as is shown in FIG. 1 of applicants' above-mentioned U.S. Pat. No. 4,566,944.

Since, in the case of a single-wire draw, the paper web is supported by one surface of the drying wire, the prior art diagonal cutters cannot be utilized on the runs between the rows of cylinders in these single wire dryers. This has presented a substantial obstacle and limitation for the installation of diagonal cutters in the very position which is the most suitable in view of the operation and functioning thereof.

An object of the present invention is thus to provide a method and apparatus for cutting a paper web wherein unsupported draws are minimized thereby avoiding breaks of the paper web due to fluttering and like causes.

It is a further object of the present invention to provide a method and apparatus for the cutting of the lead-in strip or leader of a paper web so as to permit the threading of the paper web without the use of a guiding rope.

To achieve these and other objectives as will become apparent further below, the present invention includes a method of cutting a paper web in a group of drying cylinders provided with a single-wire draw, the method comprising separating the drying wire from the paper web by one or more guide rolls or equivalent means thereby creating an open draw for the web, carrying out the cutting of the web including the diagonal cutting of the leader of the web within the open draw of the web, and, after said open draw, converging and rejoining the drying wire and the web over the following leading or drying cylinder.

The means equivalent to the above-mentioned guide rolls include, for example, known static leading or guiding devices based on contact-free airborne support.

The apparatus in accordance with the present invention includes a transversely disposed beam with the cutting element, and above said beam, one or two guide rolls for the drying wire. In case of two rolls, the first roll is placed in a position in which the drying wire and the web, which jointly arrive from the upper cylinder, are separated from each other and the drying wire is guided further around the first guide roll, and transferred to the second guide roll and, from there transferred to the lower cylinder to meet the web, after the open draw, on the surface of the lower cylinder. The transverse beam and its cutting blade is disposed in the vicinity of the free run or open draw of the web.

The construction of the cutter utilized in the present invention may be, for example, similar to that described in applicants' above-mentioned U.S. patent and which includes a rotatable or fixed blade, or some other, corresponding prior art diagonal cutter, such as a device for cutting the web with a water jet.

In general, the method of the present invention is utilized at the downstream or dry end of a group of dryers provided with a single-wire draw in a paper machine or board machine, and preferably, before the upper drying cylinder from whose lower circumference the rest of the paper web, from which the leader has been cut, is removed by a doctor and guided into the pulper located underneath the dryer. The invention may also be applied to various multi-cylinder dryers provided with a cylinder group with single-wire draw in paper or board finishing machines.

The method and the apparatus in accordance with the present invention also permits the rope-free threading of the web and can be used for cutting the leader of the web in geometries of multi-cylinder dryers such as applicants' "SYM-RUN" (trademark) dryer or the like.

BRIEF DESCRIPTION OF THE DRAWINGS

In the following, the present invention will be described in detail with reference to some exemplifying embodiments illustrated in the accompanying drawings in which.

DETAILED DESCRIPTION OF THE PRESENTLY PREFERRED EMBODIMENTS

Figure 1:
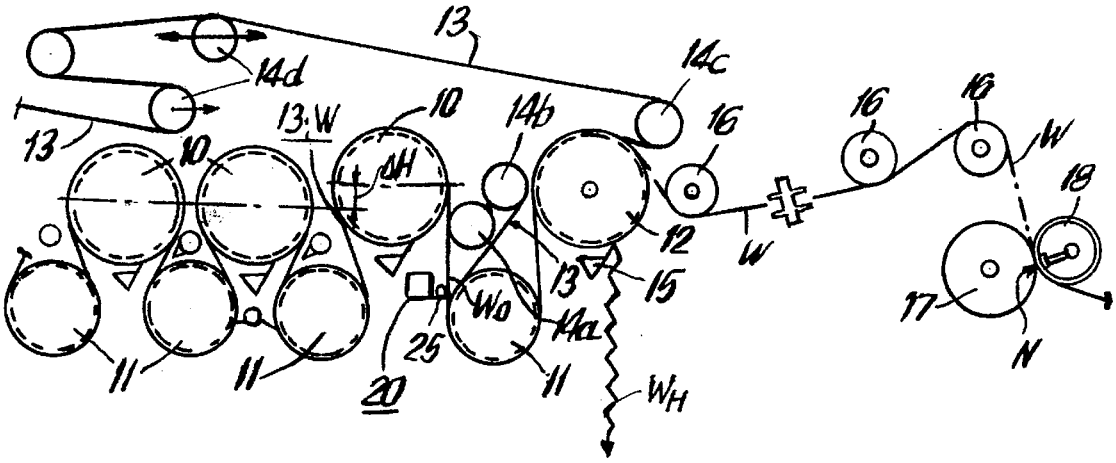
FIG. 1 is a side elevational view of the apparatus according to the present invention including a cylinder group with a single-wire draw followed by a size press.

As is shown in FIG. 1, the last group of cylinders at the dry end of a multi-cylinder dryer has a single-wire draw, which is schematically indicated by the loop of drying wire 13. The group of cylinders is comprised of a row of upper cylinders 10, 12 which are heated from the inside, and a group of lower cylinders, so-called leading cylinders 11 which are usually not heated. All cylinders may be provided with a vacuum as indicated by the dotted line. The drying wire 13 runs in serpentine configuration from an upper cylinder 10 onto a leading cylinder 11 and vice versa so that, on the upper cylinders 10, the paper web W is in direct contact with the heated surface of the upper cylinder 10, 12, while, on the lower cylinders 11, the web W is supported on the outside surface of the wire. The last two upper cylinders 10, 12 in the group of upper cylinders are preferably disposed at a somewhat higher level than the preceding cylinders 10 within the row. The difference in height is indicated with ΔH in FIG. 1. The leading cylinders 11 in the lower row are disposed at the same horizontal level.

According to the present invention, after the first upper cylinder 10 which is disposed at a higher level, the drying wire or felt 13 is separated from the surface of the cylinder 10 and from the web W by and guided around a first guide roll 14*a*, whereafter the drying wire 13 is guided by and around a second guide roll 14*b*, placed at a somewhat higher level than the first guide roll 14*a*. From the second guide roll 14*b*, the drying wire or felt 13 is returned onto the surface of the lower cylinder 11, whereon the wire converges and meets with the web W. Thus, the web W extends between the first guide roll 14*a* and the leading cylinder 11 or between an equivalent drying cylinder placed below the guide roll 14*a*, as an unsupported or open draw $W_0$ free from wire 13.

The embodiment of the present invention illustrated in the Figures is also advantageous as due to the location of the first guide roll 14*a*, the free draw $W_0$ of the web becomes relatively short, so that, at the draw $W_0$, fluttering of the web and resulting drawbacks, such as the braking of the web, are substantially reduced. A diagonal cutter 20 is disposed at the free draw $W_0$ underneath the drying cylinder 10 and between the adjoining leading cylinders 11 for cutting the web $W_0$ without also cutting the drying wire or felt 13.

The diagonal cutter 20, which is disposed at the proximity of the open or free draw of the web $W_0$ may be any cutter known per se, for example, a device similar as that described in applicants' U.S. Pat. No. 4,566,944 in which a contact-free airborne support is utilized.

Figure 2:
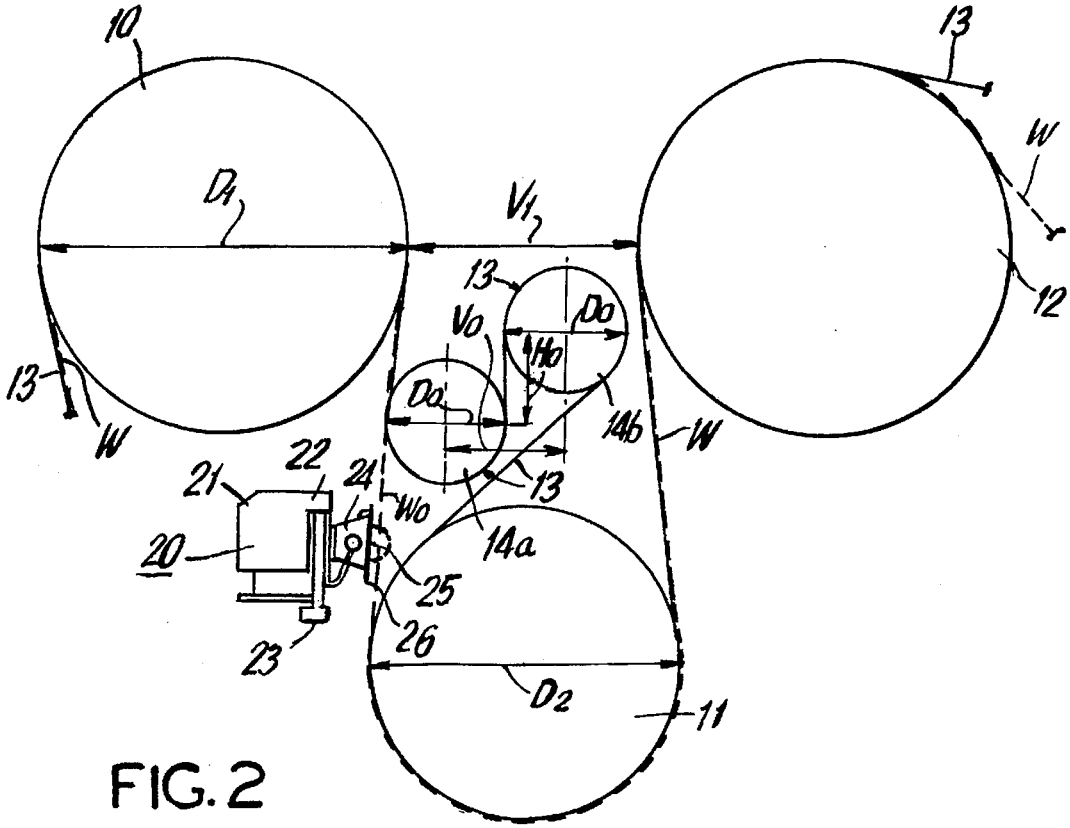
FIG. 2 is an enlarged fragmentary view of FIG. 1 showing a more detailed embodiment of the invention.

The diagonal cutter 20 shown in FIG. 2 includes a beam 21 with a guide 22, which extends transverse to the direction of movement of the paper web and wire as well as parallel to the axes of the cylinders 10, 11, 12 and from the driving side of the paper machine to the operating side thereof. A carriage 23 is movably mounted on the guide 22 of beam 21 so that the carriage is allowed to travel along the length of the beam transverse to the direction of movement of the paper. On the carriage 23, an electric motor, a pneumatic motor 24, or an equivalent drive gear is mounted, which produces the transverse movement of the carriage 23. The motor 24 rotates a circular cutter blade 25 of the diagonal cutter 20 similar to a circular saw. The cutter blade 25 cuts the web $W_0$ into two strips, whereof the narrower one, about 10 to 15 cm wide, is the leader or lead-in strip, and the wider remaining part, which is denoted with $W_H$ in FIG. 1, is detached from the lower surface of the last cylinder 12 in the cylinder group with a doctor 15, and passed into the pulper (not shown) suitably disposed therebelow. After the run of the leader has been stabilized, the diagonal cutter 20 is shifted along the transverse beam 21 thereby increasing the width of the leader and, correspondingly, narrowing the width $W_H$ of the remainder of the web. After the width has been increased to the desired or full width, the diagonal cutter 20 in accordance with the present invention is moved to one side of the web and blade 25 thereof is placed outside the width of the web W and/or the blade is pivoted away from the web.

As is shown in FIG. 1, after the top most point on the last upper cylinder 12 in the group of cylinders, the drying wire 13 is separated from the cylinder 12 and, guided by guide roll 14*c* and further by guide rolls 14*d*, passed onto the first cylinder (not shown in FIG. 1) in the single-wire group of cylinders. After the cylinder 12, the paper web W of full width or the leader is transferred from cylinder 12 and guided by the guide rolls 16 towards the next following device, which is, in FIG. 1, a size press with sizing nip N between the rolls 17 and 18.

Alternatively, in FIG. 1, there may be, for example, a Pope-type reel-up or a machine calender in place of the size press. In this connection, it should be noted that FIG. 1 merely represents one example of an application of the present invention which can, of course, be applied in a great number of different multi-cylinder geometries as will be readily apparent to the person skilled in the art.

The diameters $D_0$ of the guide rolls 14*a* and 14*b* of the present invention are preferably selected so that the rolls can be fitted in part side-by-side and in part one above the other between the drying cylinders 10 and 12. The diameter $D_0$ is, for example, about $0.5 \times V_1$, wherein $V_1$ represents the shortest horizontal distance between the adjoining cylinders 10 and 12. Generally, the rolls are dimensioned in accordance with their deflection and with their conditions of characteristic frequencies, and the gap $V_1$ between the cylinders is dimensioned based on the roll diameters in accordance with known parameters. If desired, the horizontal distance $V_1$ between the cylinders 10 and 12 can be made longer than normal. The difference in height $H_0$ between the guide rolls 14*a* and 14*b* is, for example, somewhat larger than the radius $D_0/2$ of the rolls 14*a*,14*b*. $H_0$ is selected so that the gap of about 20 to about 40 mm remains between the returning wire and the roll 14*a*. The length of the free draw $W_0$ of the web is selected between about 40 to 80%, preferably, between about 50 to 70% of the total length of the draw between the drying cylinder 10 and the leading cylinder 11.

The horizontal distance $V_0$ between the guide rolls 14*a* and 14*b* is preferably substantially equal to the diameter $D_0$ of the guide rolls 14*a*,14*b*. The diameter $D_1$ of the cylinders 10,12 is preferably somewhat larger than the diameter $D_2$ of the leading cylinders 11 in the lower row. The horizontal distance $V_1$ is of the same order of magnitude as the diameter $D_2$, and preferably about 5 to about 30% smaller than the diameter $D_2$.

If it is desired to place the drying cylinders 10,12 closer to one another than illustrated in FIG. 2, instead of the first and the second guide rolls 14*a* and 14*b*, there can be used special rolls, for example, so-called fragmentary rolls, whose diameter can be made smaller than the diameter $D_0$ of normal guide rolls.

In some applications of the invention, it is also possible to use only one guide roll 14*a* or 14*b*, in which case the guide roll is disposed slightly to the side of the straight run of the web W from the upper cylinder 10 to the lower cylinder 11. In such a case the free draw of the web W extends for the full length between upper cylinder 10 and lower cylinder 11 which is not always desirable. When only one guide roll is used, the wire or felt 13 separated from the web W is returned to the lower cylinder 11 substantially in the same direction as shown in FIG. 2.

It should be understood that the preferred embodiments and examples described are for illustrative purposes only and are not to be construed as limiting the scope of the present invention which is properly delineated only in the appended claims.

What is claimed is:

1. A method of cutting a lead-in strip of a paper web in a dryer including groups of drying cylinders having a single-wire draw, said method comprising:

(a) guiding the paper along a joint run with a wire over at least a part of the surface of a first cylinder;

(b) moving the joint run from said first cylinder onto the surface of a relatively smaller diameter second cylinder disposed downstream of the first cylinder;

(c) guiding the paper web from the second cylinder around the surface of a third cylinder disposed downstream of said second cylinder so that the paper web is not in direct contact with the surface of said third cylinder;

(d) defining an open draw spanningly between said second and third cylinders and along which the paper web moves in unsupported relation from the second to the third cylinder; and (e) cutting the paper web within the open draw between the second and third cylinders.

2. The method according to claim 1, wherein the first cylinder is a drying cylinder.

3. The method according to claim 1, wherein the third cylinder is a vacuum cylinder.

4. The method according to claim 1, additionally comprising the step of guiding the paper web from said third cylinder in supported relation onto and in direct contact with the surface of a fourth cylinder.

5. The method according to claim 4, wherein said fourth cylinder is a drying cylinder.

* * * * *